US006158585A

United States Patent [19]

Labat et al.

[11] Patent Number: 6,158,585

[45] Date of Patent: Dec. 12, 2000

[54] DISPENSER OF SMALL ITEMS OF HARDWARE SUCH AS SCREWS OR THE LIKE, AND HOLDER FOR SUCH ITEMS

[76] Inventors: Jacques Labat; Simone Labat, both of 40, chemin Lous Mats, 64510 Assat, France

[21] Appl. No.: 09/366,551

[22] Filed: Aug. 4, 1999

[30] Foreign Application Priority Data

Aug. 5, 1998 [FR] France ..... 98 10073

[51] Int. Cl.[7] ..... B65D 5/00

[52] U.S. Cl. ..... 206/372; 206/499; 206/815

[58] Field of Search ..... 206/499, 804, 206/815, 372, 373

[56] References Cited

U.S. PATENT DOCUMENTS

| | | | |
|---|---|---|---|
| 3,248,156 | 4/1966 | Repko . | |
| 4,562,938 | 1/1986 | Loder . | |
| 5,020,670 | 6/1991 | Bedford | 206/499 |
| 5,425,474 | 6/1995 | Dalea et al. . | |
| 5,542,539 | 8/1996 | Early . | |

FOREIGN PATENT DOCUMENTS

| | | |
|---|---|---|
| 2 141 283 | 2/1973 | Germany . |
| WO 95/13001 | 5/1995 | WIPO . |

*Primary Examiner*—Jacob K. Ackun
*Attorney, Agent, or Firm*—Pollock, Vande Sande & Amernick

[57] ABSTRACT

A dispenser of small hardware items includes a generally parallelepiped-shaped box with having a base containing a side opening for access to the interior. At least one removable cartridge is insertable within the box and has similar cross-sectional dimensions as the box, each cartridge containing a plurality of stacked holders for the hardware items. The cartridge further has a removable closure located at its base and positioned adjacent to the base of the box thereby permitting removal of holders one at a time through the side opening, upon removal of the closure. Each holder further includes a card having a foil backing of easily breakable material and a transparent cover bonded on preselected areas to the backing thereby creating distributed raised cells, between the backing and cover, for receiving hardware items of identical characteristics.

7 Claims, 1 Drawing Sheet

DISPENSER OF SMALL ITEMS OF HARDWARE SUCH AS SCREWS OR THE LIKE, AND HOLDER FOR SUCH ITEMS

FIELD OF THE INVENTION

The present invention relates to the field of small industrial hardware and applies more particularly to a dispenser capable of delivering, under conditions of greater reliability and efficiency, screw fasteners or the like, especially as intended for use on assembly lines or maintenance lines in the aviation industry.

BACKGROUND OF THE INVENTION

As is well known, the many operations that have to be carried out on such assembly lines, e.g. on the cabins of aircraft when fitting the panelling with which they are to be covered or on certain parts of their engines, require the use of a very large number of different screws especially designed for each use and each having to be fitted in a precise location, these screws having to meet close tolerances and satisfy stringent quality criteria.

As a result of this, these screws have quite a high cost price, which makes it particularly desirable that losses of screws in the course of these operations be as small as possible.

In addition, owing to the large number of references employed with these screws, it is vital that ceaseless rigorous checks be maintained by the technicians working on the line in order to ensure that a screw that is not exactly appropriate is not used in the place of another screw which does not quite have the characteristics required.

In the usual method used in this kind of work, these conditions are not as a rule very adequately met. In practice, the screws are presented loose in boxes or similar containers which are placed close to each other on a bench or appropriate support of the same kind, set at an appropriate height near the cabin or engine on which the operations are to be carried out, in order that the fitters can pick the screws up as ergonomically as possible, though having to select from the different boxes in order to take from one of them the only correct screw for the intended purpose.

For this reason, owing to the adjacent arrangement of the various boxes, mixing is possible, if not frequent, as the screws, which are usually short and of small diameter, do not individually include a code etched or otherwise applied to each of them by which they could be identified. Besides, the size of the screws would mean that any such code would have to be in tiny characters and/or figures, making them difficult if not virtually impossible for the user to read, quite apart from the loss of time that this would incur.

Lastly, with the conventional system of adjacent boxes containing loose screws which may be very similar but are not identical and may therefore give rise to confusion which could have serious consequences, especially if an unsuitable screw is used instead of another, the technician may also relatively frequently drop such a screw, for example while taking another screw from a particular box, or by clumsiness. These screws fall to the ground from the workbench and are never gathered up for reuse because of the importance of maintaining strict cleanliness and because of even the small risk of deformation which the impact of the fall may have occasioned.

BRIEF DESCRIPTION OF THE INVENTION

The present invention relates to a dispenser of screws or the like, and in particular of holders for such screws on which the latter are arranged ready for use in an immediately identifiable manner, which dispenser and holders avoid the abovementioned problems and in particular enable efficient and safe use of the screws, with the minimum of waste in the handling of the latter.

In another aspect, the invention also relates to the holder for screws as such which may be dispensed by this type of box.

To this end, the dispenser in question, comprising a generally parallelepiped-shaped box with a bottom base containing a side opening for access to the interior, is characterized in that this box is able to receive at least one cartridge having approximately the same dimensions in height and depth, each cartridge containing a plurality of superimposed holders for screws or the like and comprising a removable closure at its bottom, next to the base of the box, in order to deliver these holders one by one through the side opening of this base, and in that each holder consists of a card, preferably rectangular, consisting of a foil of easily breakable material and a cover to cover the foil, this cover, which is of a stiffer material, being advantageously transparent and adhesively bonded or otherwise applied to the foil and having, in a given distribution, cells in relief that define, between it and the foil, housings each reserved for one screw or the like of predetermined characteristics corresponding to an exactly identified reference.

The screw holders thus take the usual form of a "blister pack" which is in common use in other industries or for other usages, particularly in the pharmaceutical field, so that the user can break the foil of the card by simple finger pressure through one of the cells of the cover forming the housing of a screw, and so access this housing and extract the screw for the use to which it is specifically intended.

Using the proposed dispenser, the technician working on the assembly line can easily remove, one by one from the box, as needed, holders contained in the cartridge mounted in this box via the bottom of the box after the removable closure of the cartridge is withdrawn, this cartridge being placed upside down inside the box while the breakable foil of each holder removed in turn through the side opening of the base can then be broken at one of the housings defined by the cover attached to this foil in order to extract one and only one screw, while all the other screws, still carried by the holder, remain secured to the holder and so cannot be lost or dropped accidentally.

In one particular feature of the dispenser in question, the base advantageously comprises at least one central longitudinal slot leading to the side opening of the box so that a transverse force can be applied to the holder at the bottom of the cartridge to slide it towards this opening and extract it from the box.

The cartridge and the box preferably include, in their adjacent front faces, a longitudinal window above the base, so that it is possible to check how full the cartridge is with the superimposed holders which it contains, as they are extracted through the side opening.

In one preferred embodiment of the invention, the box also supports, at its top, a removable open-topped tray for collecting exhausted or not fully used holders. The tray advantageously has extensions at the sides that engage over the sides of the box for proper location of this tray.

In another embodiment, the box includes at least one internal separation allowing at least two cartridges to be placed side by side inside the box in such a way that it is possible to deliver, through the side opening of the base, separate holders containing screws corresponding to different references, coming from each respective cartridge.

Clearly, whichever embodiment is adopted, each cartridge advantageously comprises in its outer surface a label or similar means of identification on which is printed the reference of the screws carried by the holders contained in this cartridge, this reference being in particular repeated on each holder individually.

Depending on the particular case, and in particular on the relative dimensions of the holders and of the screws carried by the holders, the number of cells in each holder may be variable from embodiment to embodiment, as may also be the number of holders contained in each cartridge. Equally, the dispenser may comprise several similar boxes, themselves superimposed, to form a magazine able to supply a large number of screws of different references.

Other features of a dispenser for small items of hardware, particularly for holders for such items, such as screws in particular, made in accordance with the invention, will also be clear from the following description of an illustrative embodiment provided by way of non-restrictive indication with reference to the accompanying drawing in which:

DETAILED DESCRIPTION OF THE INVENTION

Figure 1:
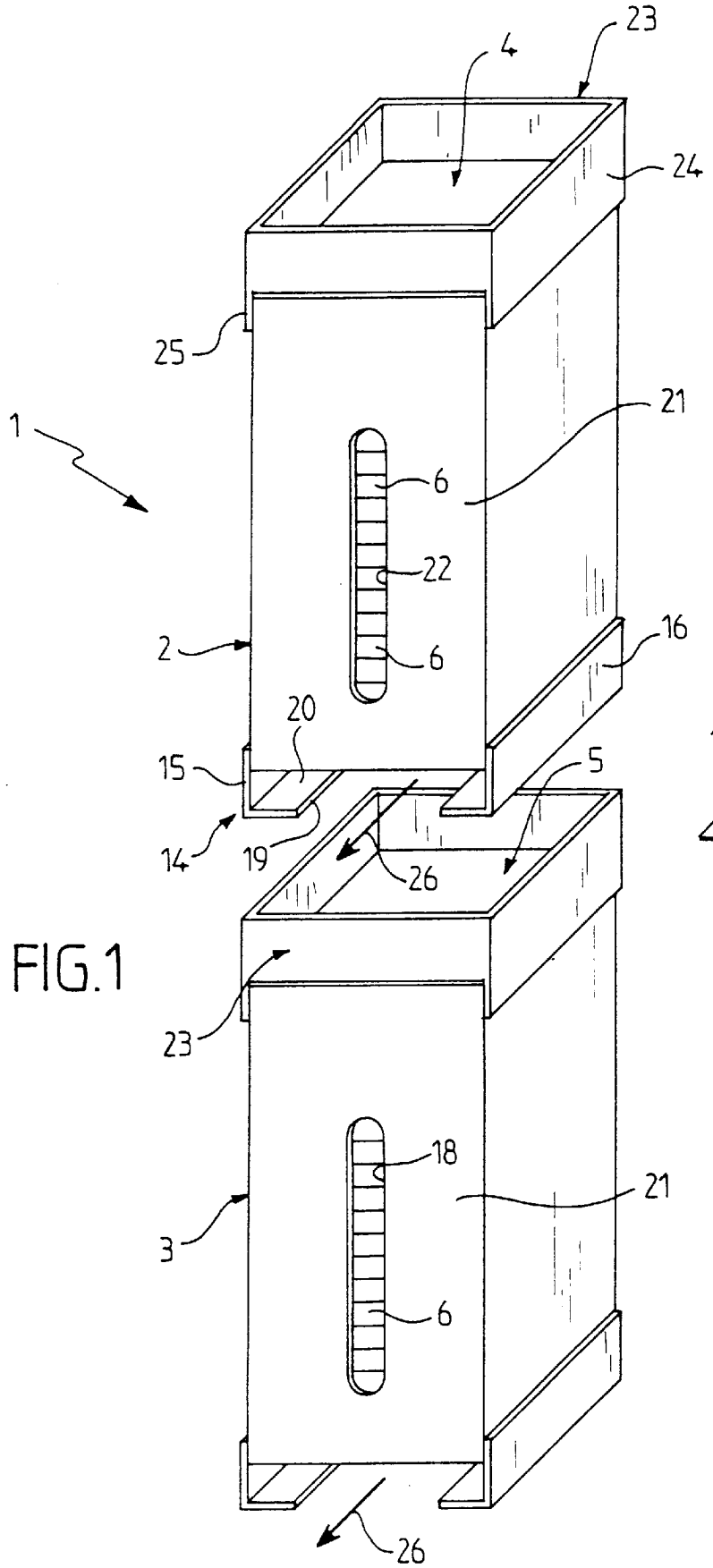
FIG. 1 is a perspective view of a dispenser according to the invention.
Figure 2:
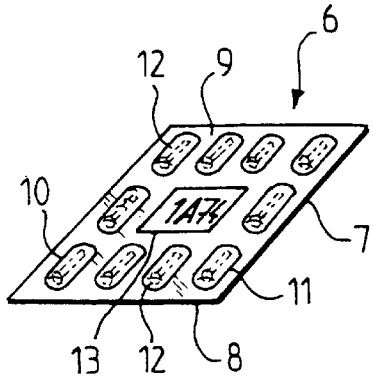
FIG. 2 illustrates a holder delivered by the dispenser as shown in FIG. 1.

In FIG. 1, the reference 1 denotes the whole of a dispenser of screws or the like according to the invention, this dispenser consisting in this case of two identical parallelepiped-shaped boxes, respectively 2 and 3, that can be superimposed one on top of the other, each box being designed to contain cartridges 4 and 5 of the same profile containing holders of screws 6, the detail of the construction of which is shown more clearly in FIG. 2.

As can be seen in this figure, each holder 6 is in the form of a thin card 7 prepared by adhesively bonding or assembling by any other conventional method a lower foil 8, of breakable material, such as an aluminium laminate or the like, and an upper cover 9 of a stiffer material, e.g. a transparent plastic material such as PVC or other material.

Cover 9 comprises a plurality of cells 10 formed in relief in such a way as to define between the cover and the adjacent surface of the lower foil 8 of the card 7, the number of housings 11, each containing a screw 12 whose characteristics are exactly determined, all the holders 6 superimposed in one cartridge 4 or 5 separately, corresponding of course to the same reference, which may be the same or different from box to box.

This reference, which may be any appropriate sign made up of letters, figures or other indications, is advantageously printed on a label 13 stuck to the card 7 of each holder 6, and also reproduced on the cartridge 4 or 5 containing these holders.

The box 2 or 3 containing a cartridge 4 or 5 has at its bottom a base 14 comprising lateral sides 15 and 16 ending in horizontal flanges 17 and 18, so that the base defines a central slot 19 between the opposite edges of these flanges and a side opening 20 adjacent to the front face 21 of the box as seen in the diagram of FIG. 1.

The face 21 of the box comprises a vertical window 22 which is also formed in the front wall of the cartridge 4 or 5, making it possible to check at any time how full each cartridge is of holders 6 stacked inside it.

Lastly, each box is usefully provided on its top with an open-topped collecting tray 23. This has extensions 24 and 25 at the sides so that it can be fitted to the box, the tray being particularly intended to take the exhausted cards 6, that is cards from which all the screws 12 have been removed, or partly used cards waiting for subsequent use.

The method of use of the dispenser of screw holders according to the invention will be deduced immediately from the description given above.

The user, typically the technician working on an assembly line, is provided with a bench (not shown) at an appropriate height on which the boxes 2 and 3 can be placed, one on top of the other in the present case, these boxes being first filled with a cartridge containing a plurality of holders 6 whose references are exactly indicated by means of the signs carried on these holders, as also on the cartridges containing them. The cartridges usually have a removable closing lid (not illustrated in the figures) which is removed before each cartridge is inverted and placed vertically in its box.

The dispenser is then ready for use: the user, by applying a simple transverse force in the direction of the arrow 26, applied to the bottommost holder of the cartridge 4 or 5 in question, through the slot 19 of the corresponding base 14, can slide this holder towards the opening 20 of the latter and extract it from the box.

The user then simply breaks the breakable foil 8 of the holder 6 where it covers a cell 10 underneath the cover 9, to extract the screw 12 from the corresponding housing 11 before using this screw. All the other screws which correspond to the same reference and are carried by the holder remain safely in their respective housings until they too are removed one by one and used.

It is therefore possible at any time to check that the screw employed corresponds to the required reference, because the dispenser and the holders delivered by it allow the batches used to be monitored and identified at any moment, while limiting losses and greatly reducing waste.

It goes without saying, of course, that the invention is not limited to the illustrative embodiment specifically described above with reference to the attached drawings, but rather encompasses all variants thereof.

In particular, it is easy to envisage placing two, or even more, juxtaposed cartridges in each box, in order to deliver screws corresponding to different references as desired, the screws remaining always identifiable by the references printed on the holders supplied by these cartridges. In this version, the front face 21 of the box will have as many checking windows 22 as cartridges.

Finally, it should be emphasized that the invention applies particularly whatever the dimensions of the screws and hence of the supports, these being limited in size and in number of screws only by what can be manufactured for a cost price that remains sufficiently low.

What is claimed is:

1. A dispenser of small hardware items, and comprising:

a generally parallelepiped-shaped box with having a base containing a side opening for access to the interior;

at least one removable cartridge having similar cross-sectional dimensions as the box, each cartridge containing a plurality of stacked holders for the hardware items, the cartridge further having a removable closure located at its base and positioned adjacent to the base of the box thereby permitting removal of holders one at a time through the side opening, upon removal of the closure;

each holder further including a card having a foil backing of easily breakable material and a transparent cover bonded on preselected areas to the backing thereby creating distributed raised cells, between the backing and cover, for receiving hardware items of identical characteristics.

2. A dispenser according to claim 1, wherein the cartridge and the box, comprise overlying front panels, each of the panels having a longitudinal window above the bases of the box and the cartridge thereby making it possible to check the supply of holders contained in the cartridge.

3. A dispenser according to claim 1, wherein the box also supports, at its top, a removable tray for collecting exhausted or partially used holders.

4. A dispenser according to claim 3, wherein the collecting tray has extensions at its sides that contact upper side sections of the box for properly locating the tray atop the box.

5. A dispenser according to claim 1, wherein the box includes at least one internal vertical separation means for allowing at least two stacks of cartridges to be placed side by side inside the box making it possible to select, through the side opening of the base, holders from either stack.

6. A dispenser according to claim 1, together with means for identifying the contents of each cartridge located on the cartridge and the individual holders within the cartridge.

7. A dispenser according to claim 1 wherein a plurality of similar boxes are stacked, to form a magazine able to supply a large number of items.

* * * * *